US007603998B2

(12) United States Patent
Finstad

(10) Patent No.: US 7,603,998 B2
(45) Date of Patent: Oct. 20, 2009

(54) BARREL ATTACHMENT FOR GAS GUN

(75) Inventor: Mark T. Finstad, Oak Grove, MN (US)

(73) Assignee: Kee Action Sports I LLC, Sewell, NJ (US)

( * ) Notice: Subject to any disclaimer, the term of this patent is extended or adjusted under 35 U.S.C. 154(b) by 116 days.

(21) Appl. No.: 11/478,814

(22) Filed: Jun. 30, 2006

(65) Prior Publication Data

US 2007/0017498 A1 Jan. 25, 2007

Related U.S. Application Data

(60) Provisional application No. 60/695,732, filed on Jun. 30, 2005, provisional application No. 60/695,685, filed on Jun. 30, 2005.

(51) Int. Cl.
*F41B 11/00* (2006.01)

(52) U.S. Cl. ..... 124/81; 124/73; 124/83

(58) Field of Classification Search ..... 124/73, 124/74, 81, 83, 84, 85
See application file for complete search history.

(56) References Cited

U.S. PATENT DOCUMENTS

| | | | | | |
|---|---|---|---|---|---|
| 1,187,218 | A | | 6/1916 | Wister | |
| 1,348,987 | A | | 8/1920 | Fischer | |
| 2,119,169 | A | | 5/1938 | Lauf | |
| 2,182,369 | A | * | 12/1939 | Barron | 124/81 |
| 2,345,089 | A | | 3/1944 | Born | |
| 3,101,028 | A | | 8/1963 | Berge | |
| 3,288,127 | A | * | 11/1966 | Bullock | 124/73 |
| 3,329,063 | A | | 7/1967 | Ehrenburg et al. | |
| 3,510,222 | A | | 5/1970 | Shaw | |
| 3,521,616 | A | | 7/1970 | Chang et al. | |
| 3,610,222 | A | | 10/1971 | Hartman | |
| 3,617,000 | A | | 11/1971 | Probst et al. | |
| 3,669,087 | A | | 6/1972 | Hamrick et al. | |
| 3,726,266 | A | | 4/1973 | Palmer | |
| 3,838,676 | A | | 10/1974 | Kahelin | |
| 3,917,265 | A | | 11/1975 | Schrier et al. | |
| 3,930,486 | A | | 1/1976 | Kahelin | |
| 3,989,027 | A | | 11/1976 | Kahelin | |
| 3,996,916 | A | | 12/1976 | Koehn et al. | |
| 4,014,307 | A | * | 3/1977 | Horvath | 124/81 |
| 4,073,280 | A | | 2/1978 | Koehn et al. | |
| 4,185,824 | A | | 1/1980 | Natwick | |
| 4,215,867 | A | | 8/1980 | Natwick | |
| 4,249,465 | A | | 2/1981 | Ballmann | |
| 4,250,862 | A | | 2/1981 | Speer | |
| 4,318,329 | A | | 3/1982 | Rentzsch et al. | |

(Continued)

*Primary Examiner*—John Ricci
(74) *Attorney, Agent, or Firm*—Volpe and Koenig, P.C.

(57) ABSTRACT

This invention is a barrel attachment attachable to the firing end of the barrel of a compressed gas gun and a method of using the same. The barrel attachment allows a user to spin a projectile fired from the gas gun just before it exits the barrel attachment. This spin alters the projectile's normally straight trajectory; in other words, it makes the projectile curve. The barrel attachment is adjustable. In the preferred embodiment, the user or shooter can adjust the amount of spin and thereby the amount that the projectile curves by rotating an adjustment sleeve about the barrel attachment, which causes contact pads to protrude into the passage of the barrel attachment. In the preferred embodiment, the user can adjust the direction of curve by rotating the barrel attachment about the gun barrel.

7 Claims, 16 Drawing Sheets

U.S. PATENT DOCUMENTS

| | | | | | |
|---|---|---|---|---|---|
| 4,323,047 | A | | 4/1982 | McIntosh et al. | |
| 4,335,701 | A | | 6/1982 | Bozich | |
| 4,345,578 | A | | 8/1982 | Speer | |
| 4,570,607 | A | | 2/1986 | Stokes | |
| 4,615,325 | A | | 10/1986 | Yamamura et al. | |
| 5,228,427 | A | | 7/1993 | Gardner, Jr. | |
| 5,265,583 | A | * | 11/1993 | Otto | 124/81 |
| 5,337,504 | A | | 8/1994 | Krumm | |
| 5,337,726 | A | | 8/1994 | Wood | |
| 5,413,085 | A | | 5/1995 | Kraeft | |
| 5,450,838 | A | | 9/1995 | Nakahigashi et al. | |
| 5,613,483 | A | | 3/1997 | Lukas et al. | |
| 5,634,456 | A | | 6/1997 | Perrone | |
| 5,640,945 | A | | 6/1997 | Slonaker et al. | |
| 5,701,878 | A | | 12/1997 | Moore et al. | |
| 5,735,256 | A | | 4/1998 | Monk | |
| 5,823,173 | A | | 10/1998 | Slonaker et al. | |
| 5,832,909 | A | | 11/1998 | Grant et al. | |
| 5,878,736 | A | | 3/1999 | Lotuaco, III | |
| 5,988,153 | A | | 11/1999 | Yoshimura | |
| 6,164,271 | A | | 12/2000 | Paulson et al. | |
| 6,324,779 | B1 | | 12/2001 | Tippmann | |
| 6,364,737 | B1 | | 4/2002 | Sterr et al. | |
| 6,520,172 | B2 | | 2/2003 | Perrone | |
| 6,526,685 | B2 | | 3/2003 | Tippmann | |
| 6,805,111 | B2 | | 10/2004 | Tippmann | |
| 7,040,310 | B2 | | 5/2006 | Finstad | |
| 2001/0032638 | A1 | | 10/2001 | Yoshimura | |
| 2005/0091900 | A1 | | 5/2005 | Tippmann | |

* cited by examiner

BARREL ATTACHMENT FOR GAS GUN

CROSS REFERENCE TO RELATED APPLICATIONS

This application claims the benefit of U.S. provisional patent application Nos. 60/695,685 and 60/695,732, filed on Jun. 30, 2005, the entire contents of which are incorporated by reference as if fully set forth herein.

FIELD OF INVENTION

The present invention relates generally, to accessories for compressed gas guns, and more specifically, to barrel attachment accessories that can affect the trajectory of a projectile fired from a compressed gas gun. A method of imparting spin on a projectile fired from a compressed gas gun is also provided.

BACKGROUND

Action sports such as paintball have become very popular activities. Paintball is a sporting game having two teams of players usually trying to capture one another's flag. The sport is played on a large field with opposing home bases at each end. Each team's flag is located at the player's home base. In addition, all of the players have compressed gas guns (referred to herein as either "guns," "compressed gas guns," "markers" or "paintball markers") that shoot projectiles commonly referred to as paintballs. The paintballs are generally spherical gelatin capsules filled with liquid paint or dye. During play of the sport, the players on each team advance towards the opposing team's base in hopes of stealing the opposing team's flag, without being eliminated from the war game. A player is eliminated from the game when the player is hit by a paintball fired from an opposing player's marker. When the paintball hits a player it usually ruptures leaving a "splat" of paint.

Compressed gas guns using a source of compressed gas for firing projectiles are well known. Examples of compressed gas guns used in the sport of paintball, include products sold under the brand names EMPIRE, INDIAN CREEK DESIGNS, DIABLO, 32 DEGREES, and BT. As shown in FIGS. 1 and 10, generally, compressed gas guns 10 include a gun body 12, grip 14, barrel 16, and trigger 18. The barrel is usually 10 to 14 inches long. It is connected to the gun body at a second end 20 and has a longitudinal bore 22—shown in FIG. 5, for example, in communication with the breech 24 (chambering area) of the gun body, as shown in FIGS. 1 and 10. The paintball 26 passes from the breech 24 into the barrel bore 22 and then is expelled under the force of compressed gas. The markers are hand held and easily transportable and generally weigh no more than about 7 pounds without the gas tank and paintball feeder or "hopper" attached. As used herein, "compressed gas gun" refers to any gun or similar launching mechanism for use in sport wherein a projectile is fired via the force of compressed gas, and includes paintball markers.

As used herein, "projectile" or "projectiles" refers to both paintballs, and other projectiles used in sport and game play. For example, the sport of airsoft utilizes compressed gas guns firing pellets. In the sport of paintball, paintballs generally have a diameter of about between 0.67 and 0.71 inches. Paintballs are generally fired from paintball markers at a velocity of between about 200 and about 500 feet per second.

Because paintball is often played on a large field, compressed gas guns must be able to shoot over long distances and with accuracy. In addition, as shown in FIGS. 6-9 and explained later, the sport of paintball may be played on a field with obstacles ("paintball bunkers") or in the woods. Players 86 often hide behind bunkers, trees or other obstacles 88 to avoid being hit with a paintball. To more easily strike these players 86, some devices for altering or affecting the trajectory of a projectile fired from a compressed gas gun have been invented. One is disclosed in U.S. patent application Ser. No. 11/437,577 and U.S. Pat. No. 7,040,310. The entire contents of these are incorporated by reference herein.

It would be advantageous to have a barrel attachment for a compressed gas gun that fires a projectile for an increased distance as compared to current compressed gas guns.

In addition, it would be advantageous to have a barrel attachment for a compressed gas gun that can fire a projectile with a user selected curved trajectory.

In addition, it would be advantageous to have a barrel attachment for a compressed gas gun that can change the trajectory of a projectile fired from the gun in an easy and effective manner during sport play, without removing the barrel attachment from the gun or barrel of the gun.

SUMMARY OF THE INVENTION

The present invention satisfies the above-referenced needs. The present invention is a compressed gas gun barrel attachment comprising: a cylindrical housing having first and second ends and a through passage therebetween, said first end fittable over a gun barrel; at least one contact pad; the housing having at least one aperture therethrough, said at least one aperture dimensioned to receive at least a portion of the at least one contact pad, at least a portion of the contact pad extendible into the through passage. Further features and advantages of the invention shall become clearer from the description of the preferred embodiments, made with reference to the attached drawings, wherein like numerals refer to like elements.

DETAILED DESCRIPTION OF THE PREFERRED EMBODIMENTS

Figure 1:
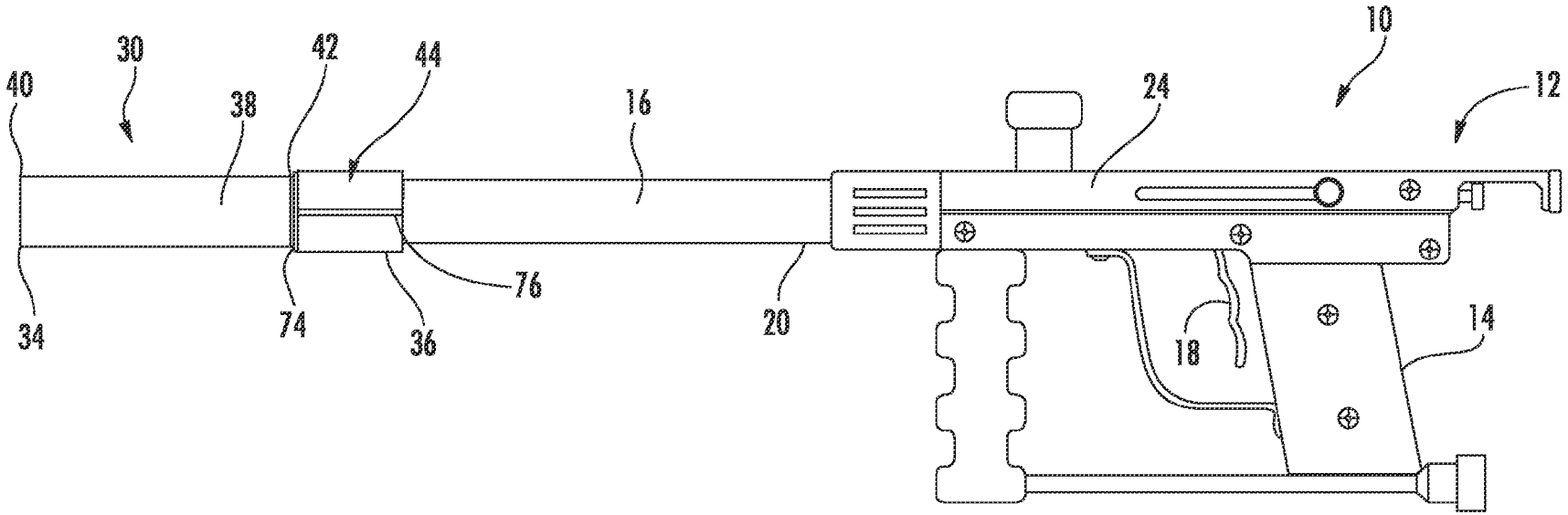
FIG. 1 is a side view of a first embodiment of the barrel attachment of the present invention attached to the firing end of a paintball marker.
Figure 9:
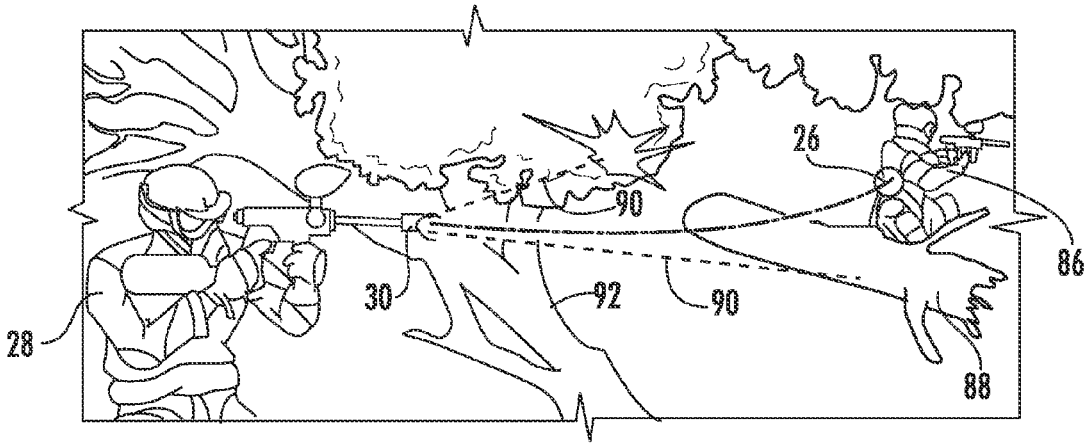
FIG. 9 is a perspective view of a user firing a compressed gas gun with either the first or second embodiments of the barrel attachment of the present invention attached to the firing end of the barrel.
Figure 10:
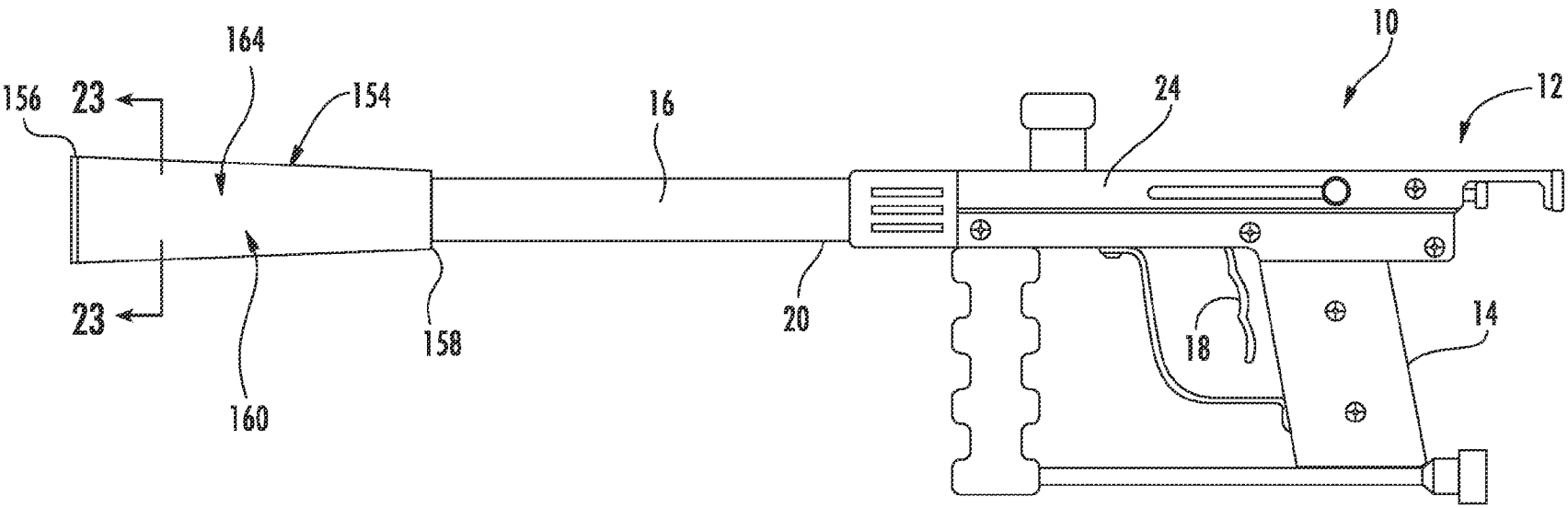
FIG. 10 is a side view of the second and preferred embodiment of the barrel attachment of the present invention connected to the firing or first end of a paintball marker.

For purposes of this detailed description, all reference to direction or orientation are from the perspective of a user 28 (shown in FIGS. 6-9) firing a compressed gas gun 10 including the barrel attachment 30 of the present invention, by holding the gun 10 upright in its normal firing position (i.e., at "zero degrees" or in a "firing position"—shown in FIGS. 1 and 10). For example, "left" refers to a position closer to the user's 28 left side, i.e., left arm or leg, and "right" refers to a position closer to the user's right side. "Rear" or "rearward" refers to a portion or portions closer to the user 28 and "forward" refers to a portion or portions farther away from the user 28.

The present invention is directed to various embodiments of a barrel attachment 30 of the present invention and accessories therefore, that can be affixed to the firing end 32 (or "muzzle end") of the barrel 16 of a compressed gas gun 10 that fires projectiles 26 using a source of compressed gas (not shown).

FIGS. 1-5, show a first embodiment of the present invention. In this embodiment, the barrel attachment 30 has a first end 34, a second end 36 opposite the first end 34 and a housing. Preferably, the barrel attachment 30 is cylindrically shaped, and formed from a material such as plastic, rubber or metal.

Figure 2:
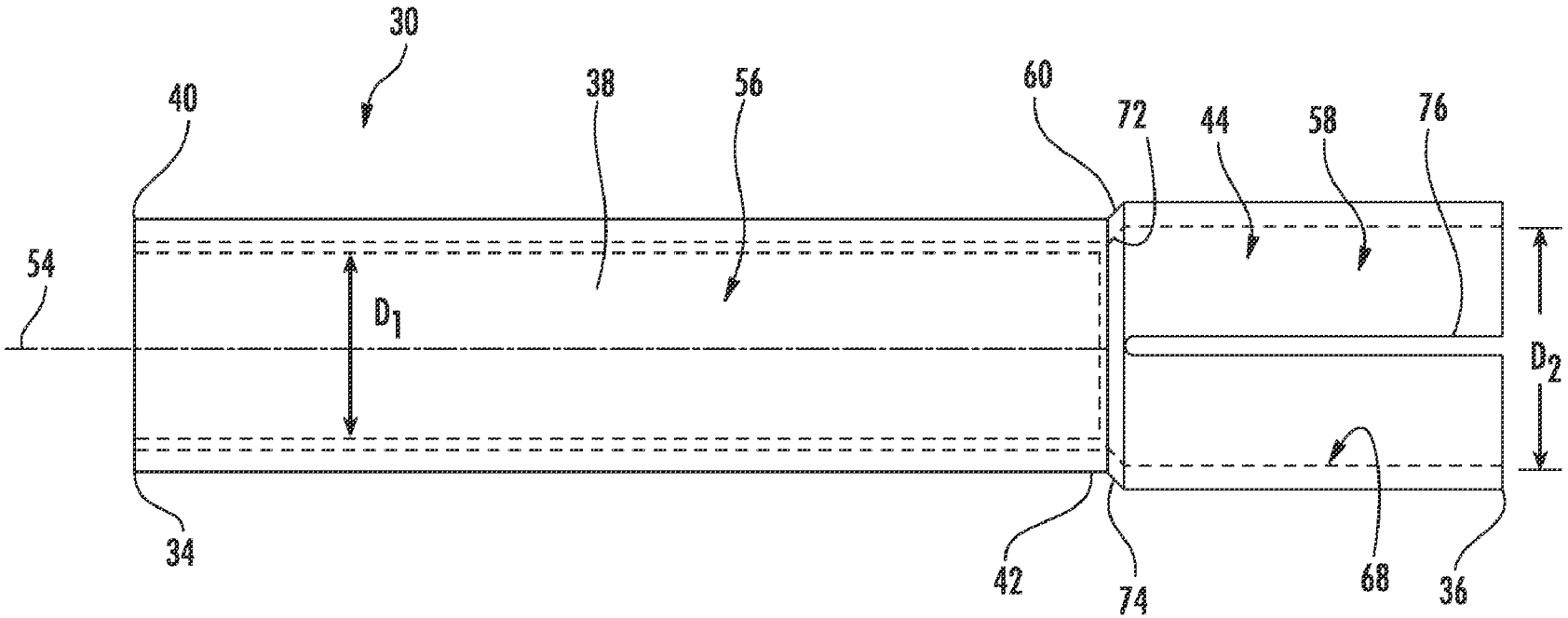
FIG. 2 is a side plan view of the embodiment of the barrel attachment shown in FIG. 1.
Figure 3:
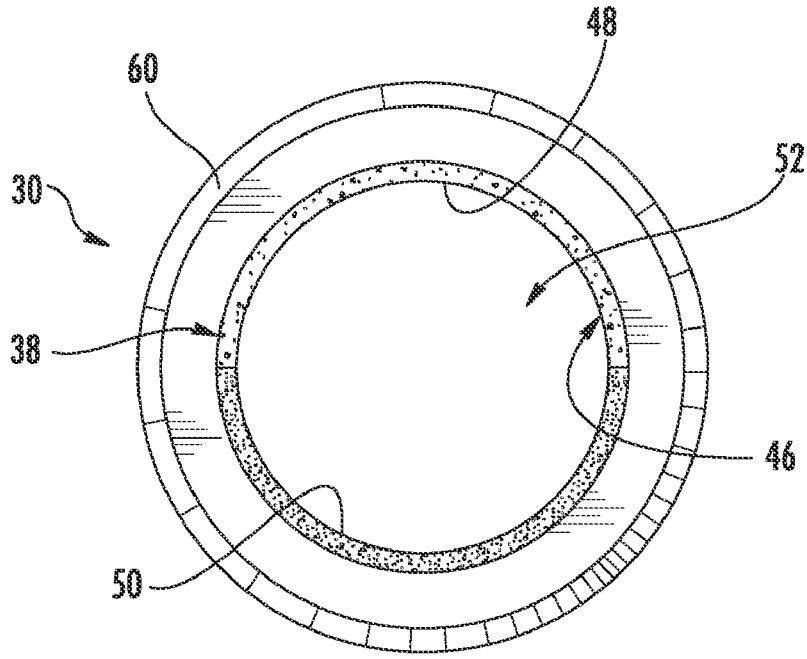
FIG. 3 is a front plan view of the barrel attachment shown in FIG. 2.

As shown in FIGS. 1 and 2, the barrel attachment 30 has a first portion 38 having a first end 40 and a second end 42 and a sleeve portion or sleeve 44 extending adjacent the second end 42 of the first portion 38. As shown in FIG. 3, the first portion 38 includes an inner wall 46 divided into two portions designated as a first inner wall 48 that runs along half of the circumference of the inner wall 46 of the first portion 38, and a second inner wall 50 that runs along the other half of the circumference of the inner wall 46 of the first portion 38.

Figure 4:
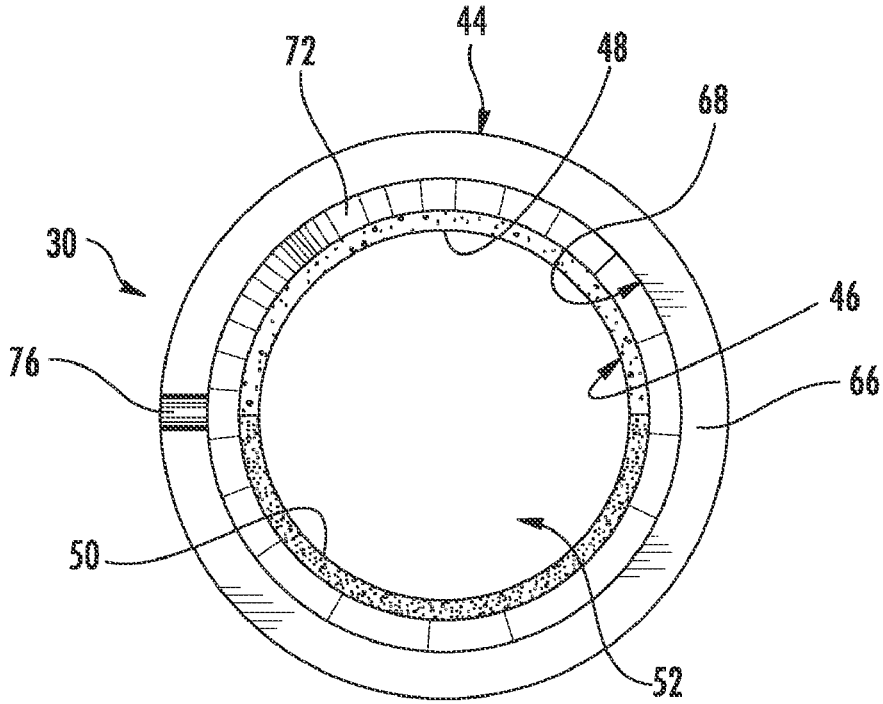
FIG. 4 is a rear plan view of the barrel attachment shown in FIG. 2.
Figure 5:
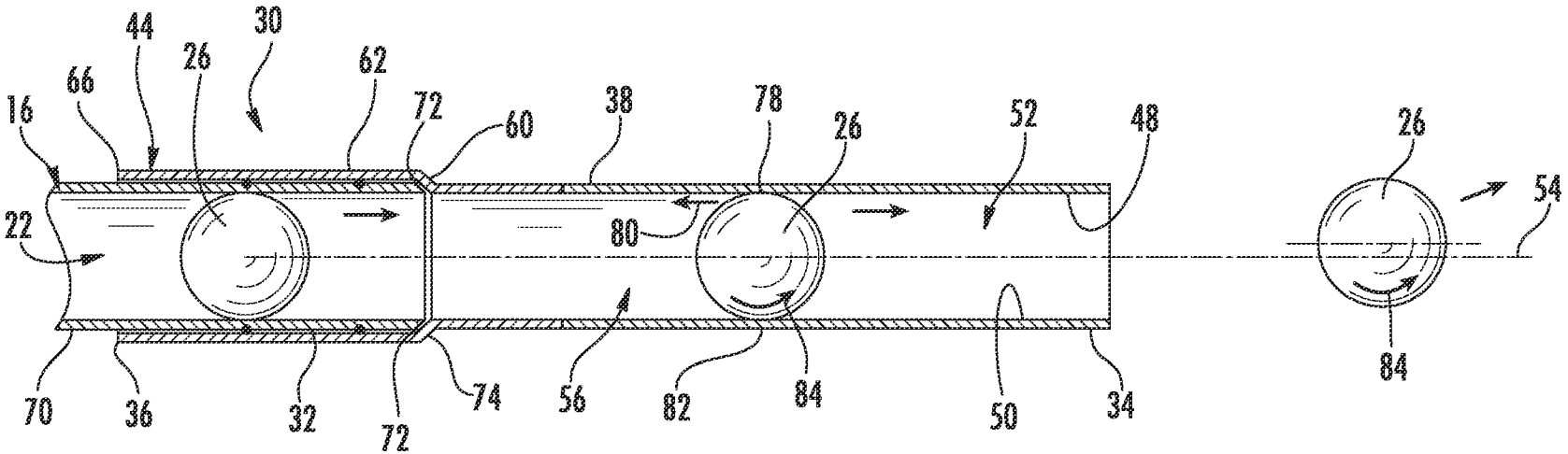
FIG. 5 is a side cutaway view of the barrel attachment shown in FIGS. 1 and 2 with a projectile passing through the longitudinal passage.

The walls 48 and 50 define a through passage or longitudinal projectile passage 52 that runs along a central longitudinal axis 54 (shown in FIG. 2) through the barrel attachment 30. Preferably, the walls 48 and 50 are curved (as shown in FIGS. 3 and 4) to correspond to the shape of the outer surface of a spherical projectile 26 fired though the passage 52, which is shown in FIG. 5. As shown in FIGS. 3 and 4, the walls 48 and 50 form a cylindrical passage 52. As shown in FIG. 2, the passage 52 includes a first section 56 within the first portion 38 having a first diameter D1, and a second section 58 within the sleeve 44 having a second diameter D2, with the diameter D1 being less than the diameter D2. An outer ridge 60 is provided between the first portion 38 of the barrel attachment 30 and the sleeve 44 that corresponds to the change in diameter from D1 to D2.

As shown in FIGS. 2 and 4, an annular wall 68 forms the sleeve 44. As shown in F*igs*. 4 and 5, the annular wall 68 defines a barrel receiving passage 62 of diameter "D2" which forms the rear section 58 of the passage 52 within the sleeve 44. The second end 36 is fittable over the gun barrel 16. As shown in FIG. 5, the sleeve receives the firing end 32 of the barrel 16 at the second end 66 of the sleeve 44. As shown in FIG. 5, the barrel receiving passage 62 is shaped to conform to the shape of the outer housing 70 of the gun barrel 16. Also shown in FIG. 5, the diameter of the barrel receiving passage 62 is the same size as or slightly larger than the diameter of the first section 56 of the longitudinal passage 52 but slightly smaller than the second section 58 of the longitudinal passage 52. As shown in FIG. 5, an inner ridge 72 is formed where the longitudinal passage 52 and the barrel receiving passage 62 meet, which is adjacent the first end 74 of the sleeve 44.

As previously provided, the barrel receiving passage 62 is sized so that the inner diameter is preferably, slightly smaller than the outer diameter of the gun barrel 16, so that a portion of the first end 32 of the gun barrel 16 will be tightly received at least partially within the barrel receiving passage 62 when the sleeve is expanded by the expansion slot 76 (shown in FIG. 2). As shown in FIG. 5, the sleeve 44 slides tightly over the outer surface 70 of the muzzle end 32 of the gun barrel 16. As shown in FIGS. 1 and 2, the sleeve 44 may include at least one expansion slot 76, which, along with the preferably elastic material comprising the sleeve 44, (such as plastic, metal or hard rubber) allows the sleeve passage 62 to fit tightly over the first end 32 of the barrel 16.

The fit of the sleeve 44 about the first end 32 of the barrel 16 secures the barrel attachment 30 to the first end 32 of the barrel 16 through a friction fit between the annular wall 68 of the sleeve 44 and the outer wall 70 of the gun barrel 16 so that the barrel attachment 30 remains in it its position relative to the gun barrel 16. Because the fit of the sleeve 44 about the first end 32 of the gun barrel 16 is not permanently fixed, the barrel attachment 30 may be turned clockwise or counter-clockwise about the first end 32 of the gun barrel 16 by a user 28. The sleeve 44 is preferably sized and formed so that the barrel attachment 30 will not rotate about or dislodge inadvertently from the first end 32 of the gun barrel 16 when a user 28 fires a projectile 26 from the gun 10, but will permit the user 28 to rotate the barrel attachment 30 about the first end 32 of the gun barrel 16. The sleeve 44 may also be secured about the barrel 16 by threads, a tight flange-in-groove connection such as the one shown in U.S. patent application Ser. No. 11/437,577, clamps, or any other means that provide a secure connection while allowing the user to remove, rotate, and/or reattach the barrel attachment 30 to the barrel 16 during sport or play.

As shown in FIG. 5, the inner ridge 72 of the sleeve 44 assists in aligning the muzzle end 32 of the gun barrel 16 within the sleeve 44, and thereby aligns the bore 22 of the barrel 16 with the passage 52. The passage 52 has at least a portion 38 that has a diameter smaller than or the same size as the diameter of the barrel bore 22. Thus, as shown in FIG. 5, a projectile 26 passing through the passage 52 will contact the first inner wall 48 and the second inner wall 50 during the projectile's 26 travel through the passage 52.

As shown in FIGS. 3 and 4, preferably, the first inner wall 48 and the second inner wall 50 of the longitudinal passage 52 are made of materials having different coefficients of friction. For example, the material comprising the first inner wall 48 may have a coefficient of friction greater than that of the second inner wall 50. The first inner wall 48 may form a high friction contact surface, and the second inner wall 50 may form a lower friction contact surface. The first inner wall 48 may be constructed having at least a portion that is formed of silicone rubber, latex, plastic, composites, wood, textile fabric, or other frictional materials. The second inner wall 50 may be constructed of a material having low frictional properties, such as Teflon®, graphite, or a smoothed metal surface. Alternately, a portion of the first inner wall 48 can be scored, carved, patterned or etched, so as to provide a frictional surface.

As shown in FIG. 5, a projectile 26 passing through the longitudinal passage 52 contacts the first inner wall 48 and the second inner wall 50 as the projectile 26 travels through the passage 52 within the first portion 38 of the barrel attachment 30. By way of example, as shown in FIG. 5, the barrel attachment 30 may be oriented with the first inner wall 48 as the top of the barrel attachment 30, and the second inner wall 50 oriented as the bottom of the barrel attachment 30. Where the first inner wall 48 is at least partially formed from a material having a coefficient of friction higher than the material forming the second inner wall 50, the projectile 26 will contact the first inner wall 48 such as shown by illustrative point of contact 78 in FIG. 5. A frictional force 80 will be imparted upon the projectile 26 by the frictional surface of the first inner wall 48. The frictional force 80 decelerates the rotation of the surface of the projectile 26 at the upper contact point 78 more rapidly that at the lower contact point 82, which causes backspin 84.

With the barrel attachment oriented as in FIG. 5, backspin 84 will be imparted upon the projectile 26, due to the various frictional forces 80. This "backspin" is illustrated by the arrow of rotation 84 in FIG. 5. This backspin will produce an altered trajectory that can increase the distance that the projectile travels. For example, putting "backspin" 84 on the projectile causes the projectile 26 to travel farther and ultimately straighter due to the "Magnus Effect." The Magnus Effect provides, essentially, that increased lift results from different levels of air pressure on the surfaces of the projectile 26 when it backspins 84. When a projectile is fired without spin its trajectory is parabolic. In other words, it drops uniformly due to gravity. To compensate for this drop, users 28 must fire their markers 10 above their targets 86 (shown in FIGS. 6-9). As shown in FIG. 5, when the projectile 26 is fired with backspin 84, it initially rises with respect to the horizontal axis 54. This "lift" or rise counteracts the natural drop due to gravity and causes the projectile 26 to have ultimately, a straighter trajectory and therefore, travel farther than if shot without spin. The straight trajectory also allows the user 28 to fire the marker 10 more accurately because he or she can aim directly at the target 86. The more spin on the projectile 26, the more the projectile's 26 trajectory is altered. A detailed explanation of the Magnus Effect can be found in "Aerodynamics of sports balls," Rabindra D. Mehta, in Annual Reviews of Fluid Mechanics, 1985, Watts, R. G. and Ferrer, R. (1987), "The lateral force on a spinning sphere: Aerodynamics of a curveball," American Journal of Physics 55, 40-44, and Briggs, L. J. (1959), "Effect of spin and speed on the lateral deflection of a baseball; and the Magnus effect for smooth spheres," Am. J. Phys., 27, 589, which is incorporated by reference as if fully set forth herein.

If the barrel attachment 30 is oriented with the first inner wall 48 and the second inner wall 50 rotated in a different orientation, other spin orientations will be imparted on a projectile 26 traveling through the passage 52. Thus, various altered trajectories can be imparted on a projectile 26 by the present invention.

Figure 6:
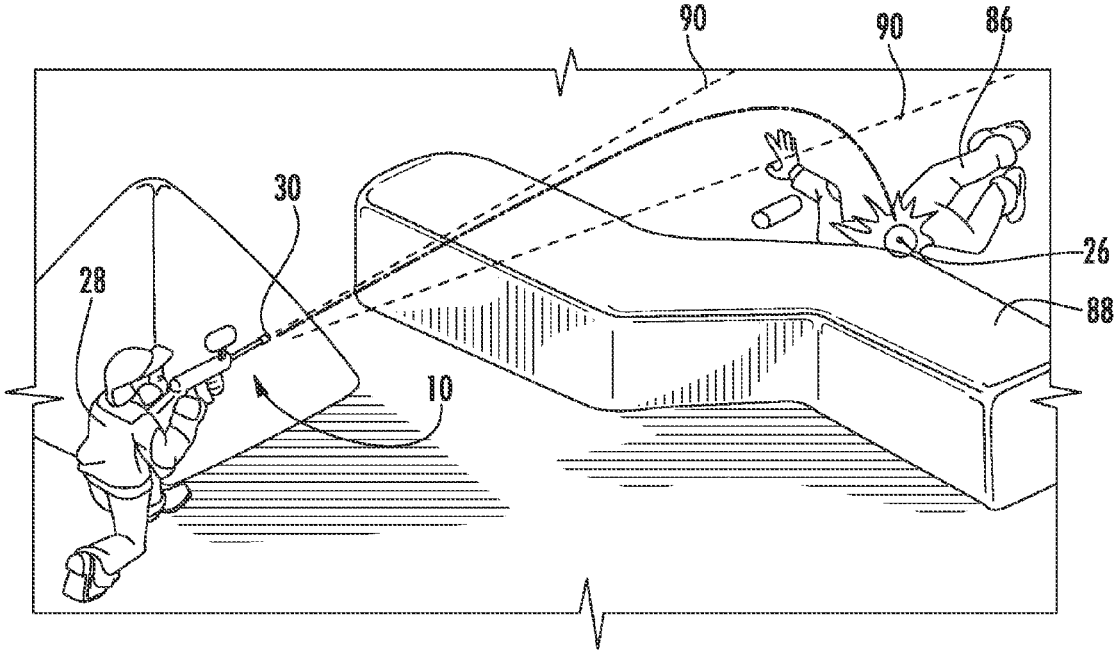
FIG. 6 is a perspective view of a user firing a compressed gas gun with either the first or second embodiments of the barrel attachment of the present invention attached to the firing end of the barrel.

Being able to fire a projectile 26 with an altered trajectory not only allows a user 28 to fire the projectile a farther distance with a straighter trajectory, it also allows a user 28 to hit an opponent or target 86 that the user 28 could not hit with a straight shot. For example, in FIGS. 6-9, a target 86 may hide behind a bunker or obstruction 88. In FIG. 6 a straight shot, depicted by the dotted line 90, would either fly over the target's 86 head or hit the obstruction 88 depending on the position of the user 28. Similarly, in FIGS. 7-9, a straight shot 90 would either miss to the left or right or hit the obstruction 88. But with the barrel attachment 30 of the present invention attached to the muzzle end 16 of the gun barrel 14, the user 28 can alter the projectile's 26 trajectory to avoid the obstruction 88 and strike the target 86. For example, in FIG. 6, the user 28 causes the projectile 26 to "dive" due to spinning the projectile 26 with "top spin". Such "top spin" is imparted on a projectile 26 by positioning the barrel attachment 30 with the second inner wall 50 (i.e., with a lesser coefficient of friction) aligned with the top of the gun 10, and the first inner wall 48 (having a higher coefficient of friction) aligned with the bottom of the gun 10.

Figure 7:
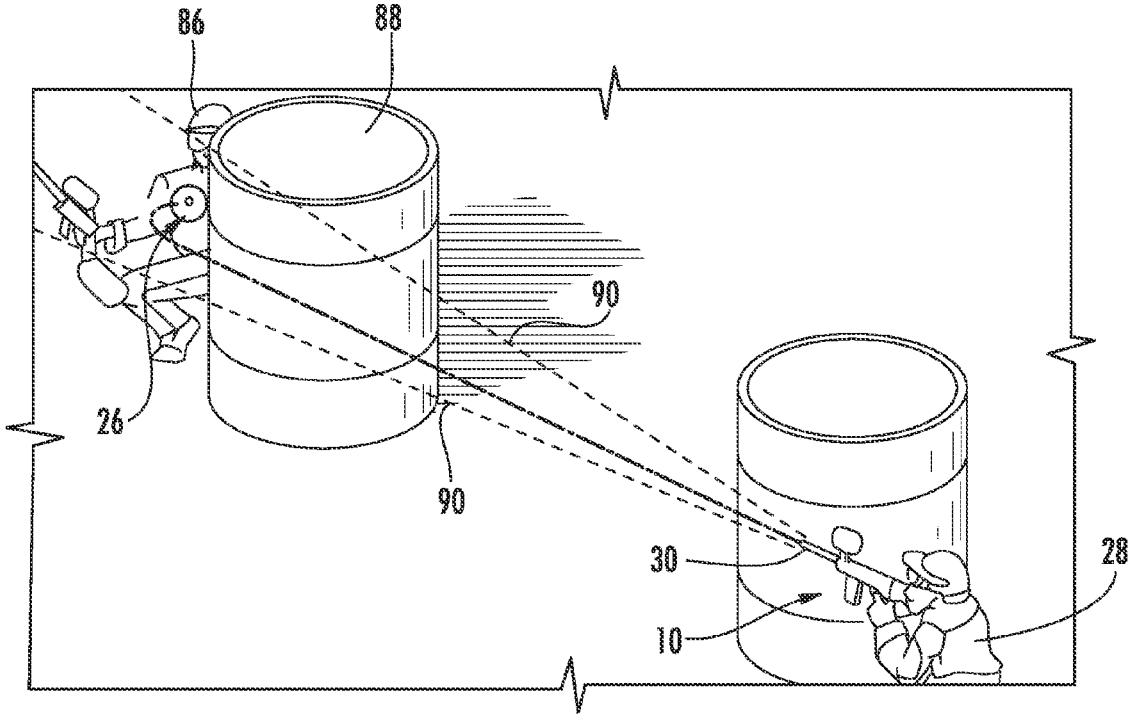
FIG. 7 is a perspective view of a user firing a compressed gas gun with either the first or second embodiments of the barrel attachment of the present invention attached to the firing end of the barrel.
Figure 8:
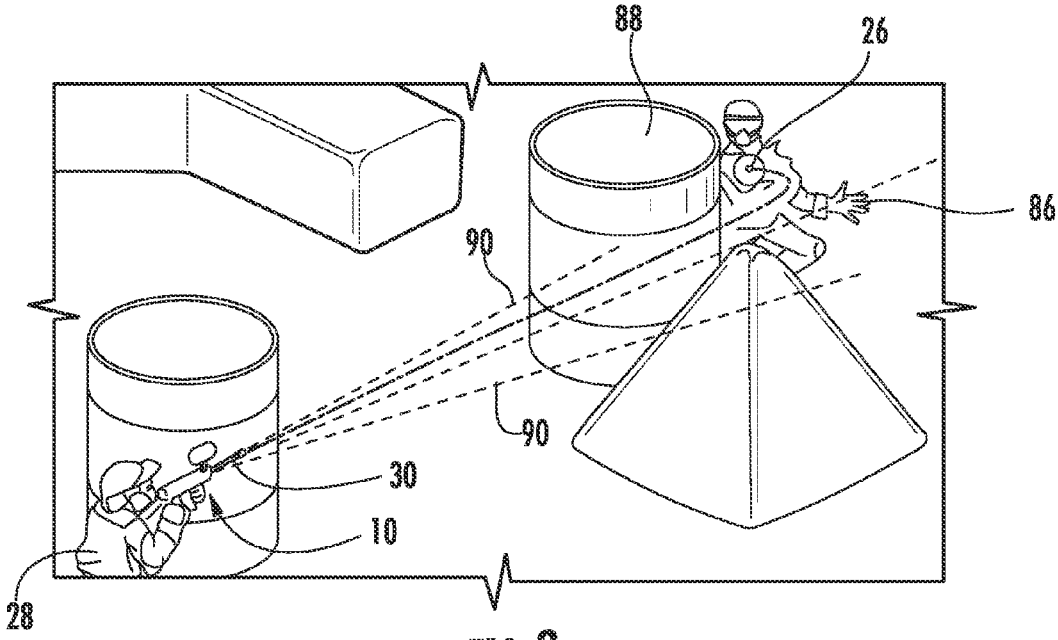
FIG. 8 is a perspective view of a user firing a compressed gas gun with either the first or second embodiments of the barrel attachment of the present invention attached to the firing end of the barrel.

In FIG. 7, the user 28 rotates the barrel attachment 30 left to cause left or "sidespin," and in FIG. 8, the user 28 rotates the barrel attachment 30 right to cause a sidespin to the right. Additionally, as shown in FIG. 9 being able to fire a projectile 26 with an altered trajectory allows a user 28 to hit a target 86 behind an obstruction 88 while the user 28 stays hidden behind another obstruction 92 such as a tree and thereby avoid being detected or being the victim of return enemy fire. Note that the trajectories in FIGS. 6-9 have been exaggerated for illustrative purposes, and may not reflect actual projectile 26 trajectories or paths. Also, the barrel attachment 94 with adjustment sleeve 154 of the second embodiment can be used to produce the trajectories shown in FIGS. 6-9 and described above.

As explained in detail below, the barrel attachment 30 is rotatable three-hundred-and-sixty (360) degrees relative to the barrel 16, which allows a user 28 to selectively vary the trajectory of a projectile 26 fired through the barrel attachment 30. Various amounts or levels of spin can be placed on a projectile 26 by varying the types and combinations of frictional materials or materials having a lower coefficient of friction, as well as the diameter of the passage 52 within the first portion 38 of the barrel attachment 30. For example, the first embodiment of the present invention allows the user 28 to adjust the amount of spin on the projectile 26 by adjusting the materials of the first inner wall 48. The greater the difference between the coefficients of friction of the materials used on the inner walls 48, 50, the more spin will be imparted on a projectile 26 traveling through the passage 52.

Figure 11:
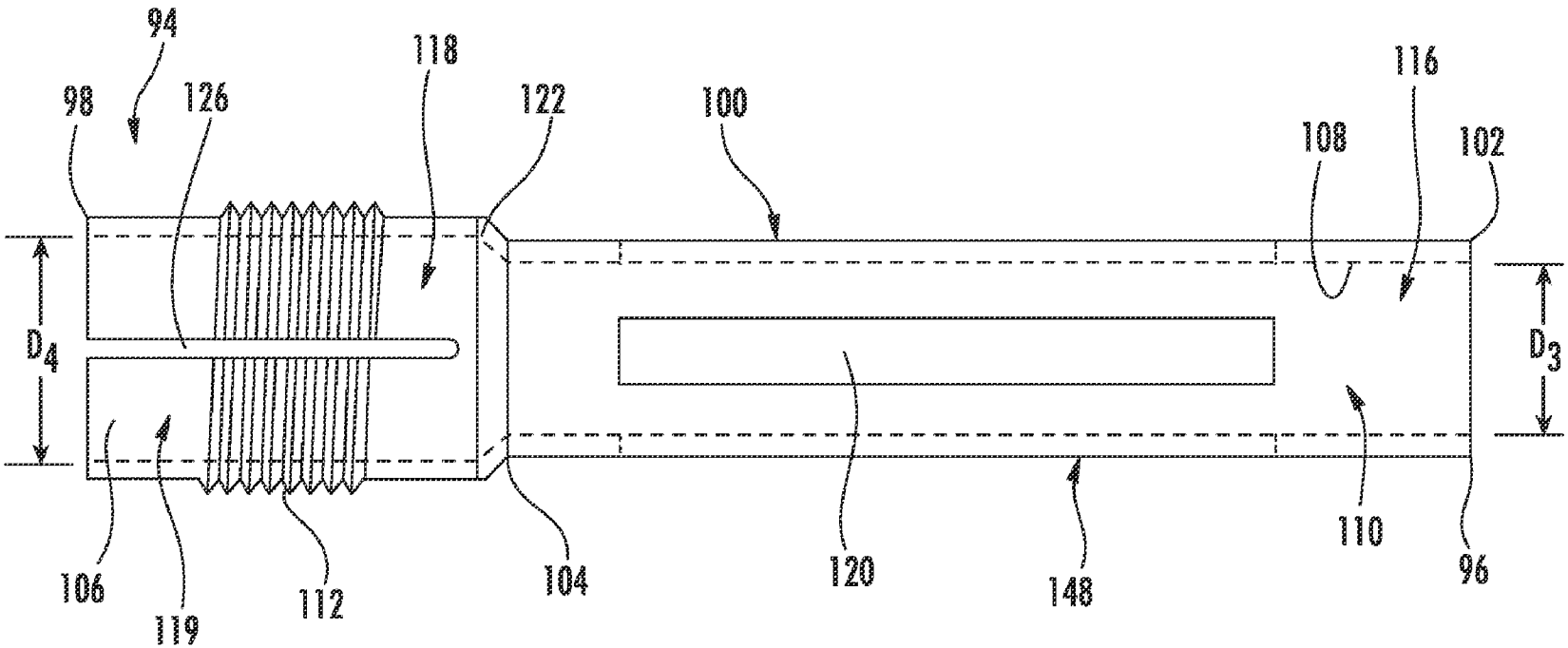
FIG. 11 is a side plan view of the second embodiment of the barrel attachment of the present invention.

FIGS. 10-27 show the second and preferred embodiment of the barrel attachment of the present invention. As shown in FIG. 11, the barrel attachment 94 is formed including a first portion 100 and a sleeve portion 106 and a housing. As further explained in detail later, the first portion 100 includes at least one aperture or slot 120 adapted to accept various inserts or contact pads 128 (shown in FIGS. 12-14) having contact surfaces 130 with varying coefficients of friction. These contact pads 128 can extend into a through passage or longitudinal passage 110 of the barrel attachment 94 (shown in FIG. 18) and impart spin 184 on a projectile 26 as shown in FIG. 25 and explained in detail later.

As shown in FIG. 11, the barrel attachment 94 has a first end 96 and a second end 98 and a first portion 100. The first portion 100 has a first end 102 and a second end 104. A sleeve 106 is formed adjacent the second end 104 of the first portion 100. The sleeve 106 has threads 112 on its outer surface and an expansion slot 126.

Figure 15:
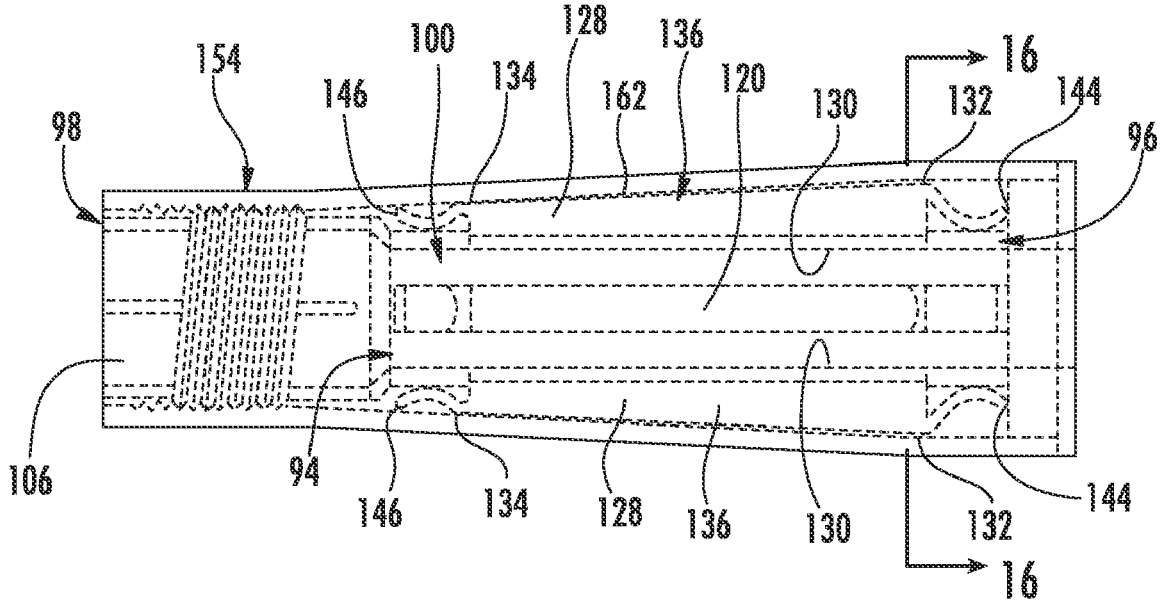
FIG. 15 is a side view of the preferred embodiment of the present invention in the rearward or first position with inner parts shown in phantom.
Figure 16:
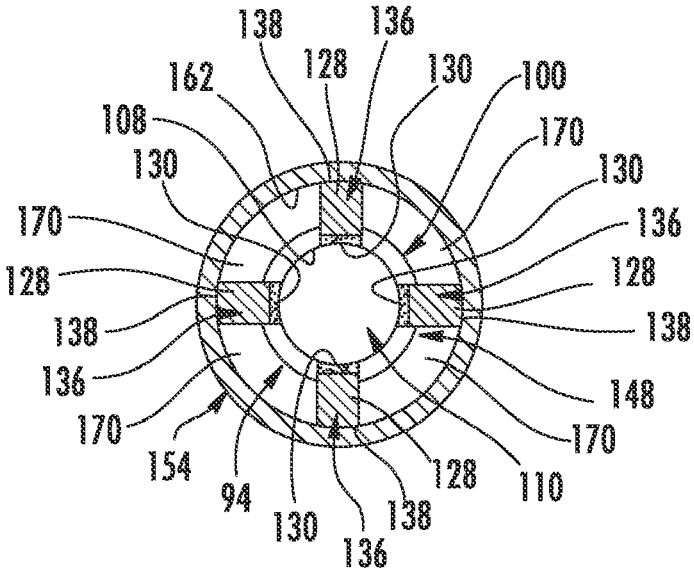
FIG. 16 is a front plan view of the embodiment shown in FIG. 15 of the present invention cut along 16-16.
Figure 17:
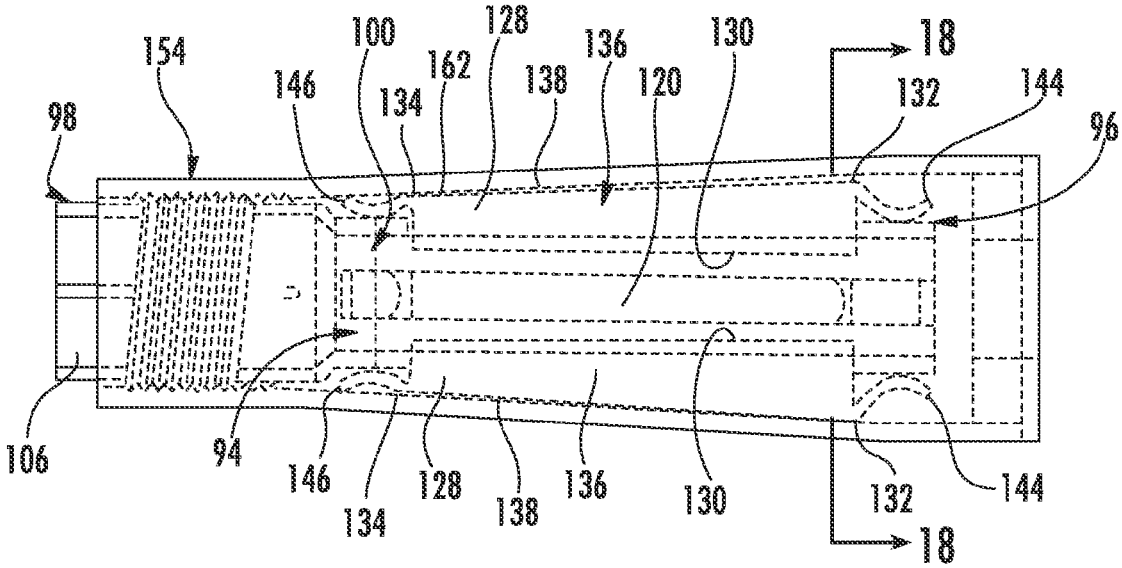
FIG. 17 is a side view of the preferred embodiment of the present invention in the forward or second position with inner parts shown in phantom.
Figure 18:
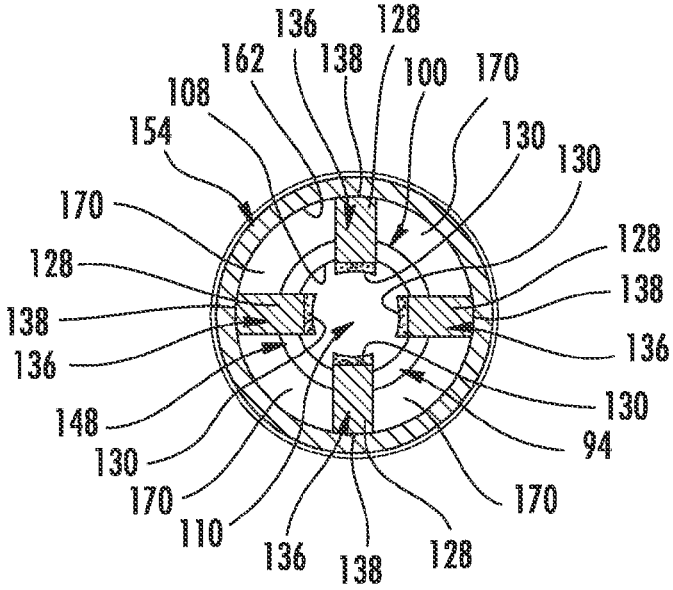
FIG. 18 is a front plan view of the embodiment shown in FIG. 17 cut along 18-18.
Figure 23:
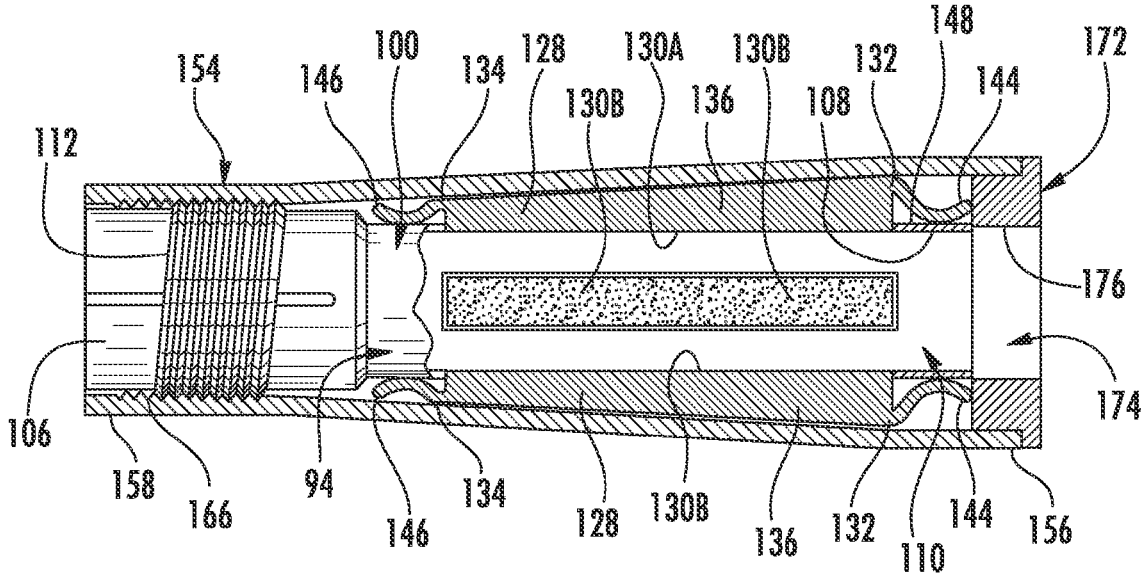
FIG. 23 is a partial side cutaway view along line 23-23 of the embodiment shown in FIG. 22.
Figure 24:
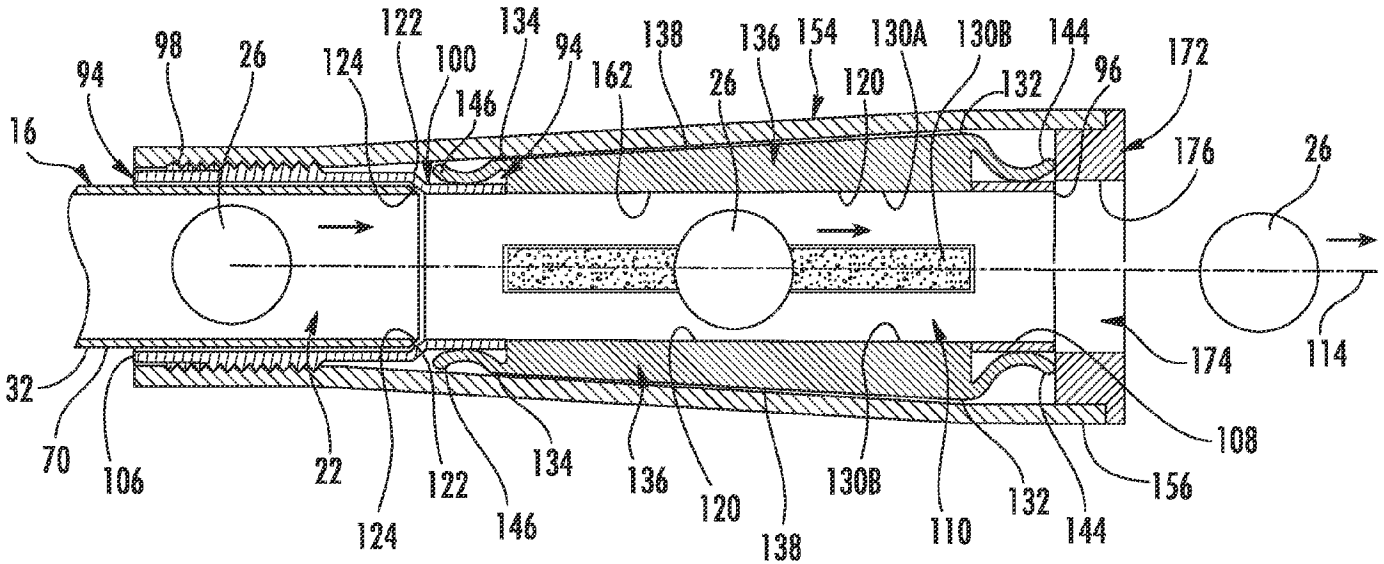
FIG. 24 is a side cutaway view along line 23-23 of the embodiment shown in FIG. 22 showing the adjustment sleeve in the first position and a projectile moving through the longitudinal passage.
Figure 25:
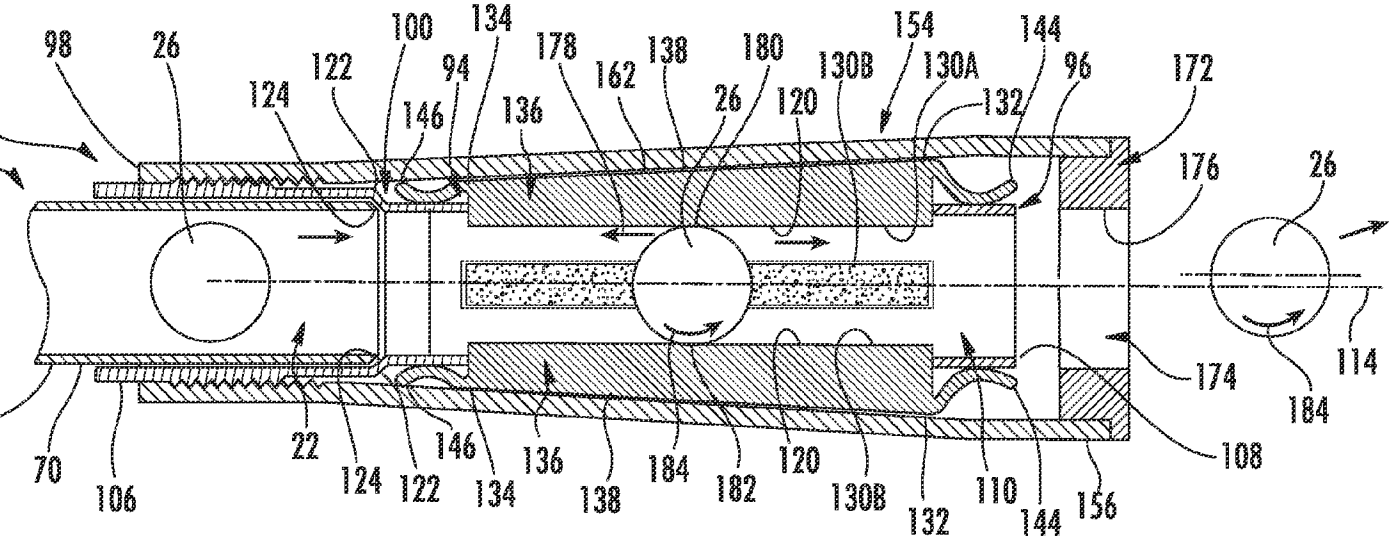
FIG. 25 is a side cutaway view along line 23-23 of the embodiment shown in FIG. 22 showing the adjustment sleeve in the second position and a projectile moving through the longitudinal passage.

As shown in FIGS. 11, 16, 18, and 23-25, an annular wall 108 forms a longitudinal passage 110 that runs along a central longitudinal axis 114 (shown in FIGS. 24 and 25) through the first portion 100 and the sleeve 106 (shown in FIGS. 11, 15, 17 and 23-25). Preferably, the wall 108 is curved (as shown in FIGS. 16 and 18) to correspond to the shape of the outer surface of a spherical projectile 26 fired though the passage 110, which is shown in FIGS. 24 and 25.

As shown in FIG. 11, the passage 110 includes a first section 116 within the first portion 100 having a first diameter D3, and a second section 118 within the sleeve 106 having a second diameter D4. The diameter D3 is smaller than the diameter D4. The second section 118 forms a preferably annular barrel receiving passage 119 for receiving the first end 32 of the barrel as shown in FIGS. 24 and 25. The annular barrel receiving passage 119 has a diameter of D4. As described in the first embodiment, the diameter D4 of the barrel receiving passage 119 is the same size as or slightly smaller than the diameter of the outer surface 70 of the first end 32 of the gun barrel 16 so that first end 32 of the gun barrel 16 fits within the barrel receiving passage 119 when that passage 119 is expanded via the at least one expansion slot 126 (FIG. 11). As shown in FIG. 11, an outer ridge 122 is provided at the second end 104 of the first portion 100 of the barrel attachment 94 and corresponds to the change in diameter from D3 to D4. As shown in FIGS. 24 and 25, an inner ridge 124 corresponds to the change in diameter and to the outer ridge 122. The inner ridge 124 assists in aligning the muzzle end 32 of the gun barrel 16 within the sleeve 106, and thereby aligns the bore 22 of the barrel 16 with the passage 110.

Figure 12:
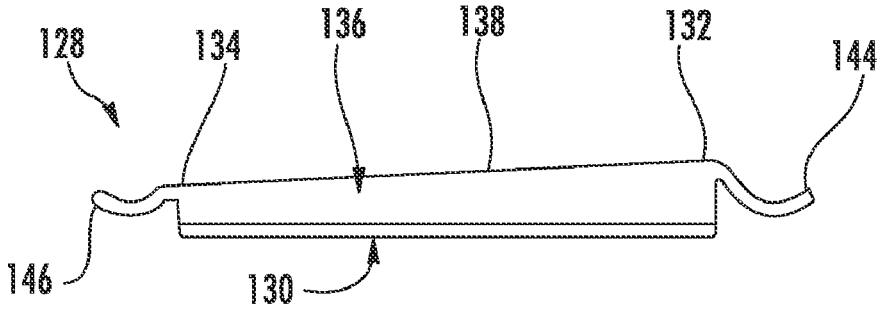
FIG. 12 is a side plan view of a contact pad for use in the second embodiment of the barrel attachment of the present invention.
Figure 13:
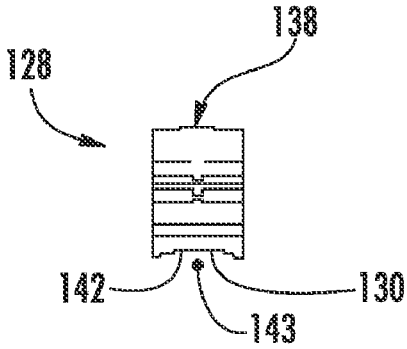
FIG. 13 is a front plan view of a contact pad for use in the second embodiment of the barrel attachment of the present invention.
Figure 14:
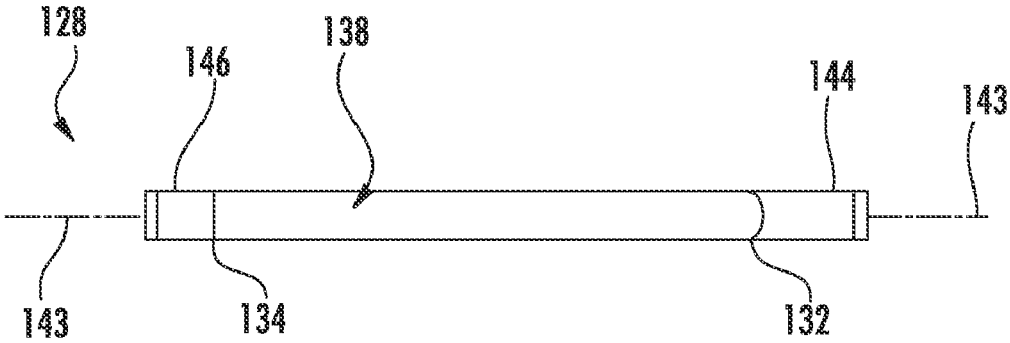
FIG. 14 is a top plan view of a contact pad for use in the second embodiment of the barrel attachment of the present invention.

As shown in FIG. 11, the first portion 100 includes at least one slot 120 formed as an opening in the outer wall 148 of the first portion 100. The slot 120 is adapted to receive a contact pad 128. FIGS. 12-14 show a contact pad 128. The contact pad 128 has a first end 132 and a second end 134 and a main body 136 with an outer side 138 and a contact surface 130. This contact surface 130 may be comprised of materials having various coefficients of friction capable of imparting spin on a projectile 26 as in the embodiment shown in FIGS. 1-5. The contact surface 130 may be formed, at least in part, of a material having a higher coefficient of friction, such as silicone, rubber, latex, elastic materials, sand paper, a scored, etched or patterned surface, or materials having similar properties. The contact surface 130 may also be formed, at least in part, of a material having a lower coefficient of friction, such as, for example, TEFLON® or graphite, or materials having similar properties.

As shown in FIG. 13, the contact surface 130 may be curved laterally in an arc 142 about the longitudinal axis 143 of the contact pad 128, which is shown in FIG. 14. As shown in FIGS. 16 and 18 and described in more detail below, the arc 142 of the contact surface 130 is preferably shaped to conform to the outer surface of a spherical projectile 26 passing through the longitudinal passage 110 (as shown in FIGS. 24 and 25). This arc 142 increases the surface area that contacts the projectile 26, which increases the frictional forces on the projectile 26.

As shown in FIGS. 12 and 14, extending from the main body 136 of the contact pad 128 adjacent each of the ends 132, 134 are a first biasing extension 144 and a second biasing extension 146. These biasing extensions 144 and 146 may be integrally formed with the contact pad 128. In the preferred embodiment, shown in FIGS. 12 and 14, these biasing extensions 144 and 146 are curved but the biasing extensions 144 and 146 may be in a coil shape in other embodiments.

Figure 22:
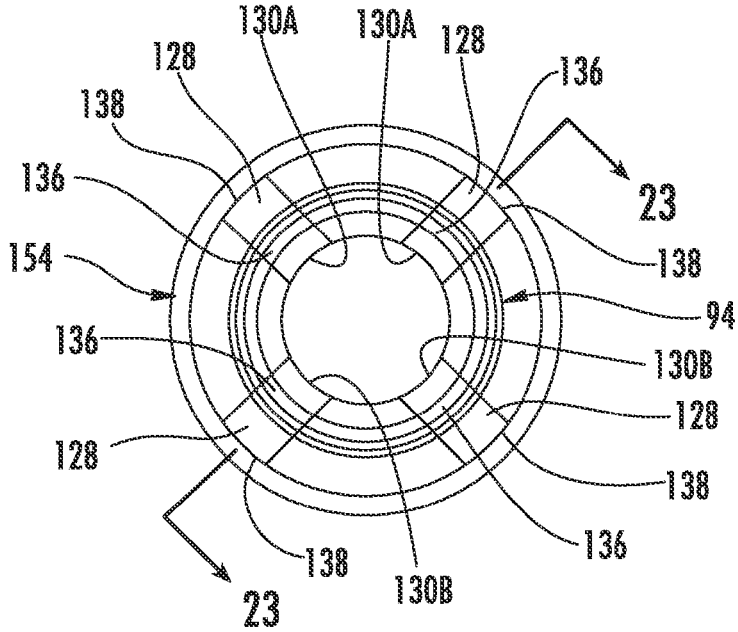
FIG. 22 is a front plan view of the preferred embodiment of the present invention rotated to produce "backspin" on a projectile.

As shown in FIGS. 15-18 and 22-23, the contact pads 128 are sized and shaped so that the contact pads 128 are received in the slots 120 (shown in FIG. 11 and in phantom in FIGS. 15 and 17) formed in the first portion 100 of the barrel attachment 94. As shown in FIGS. 15-18, the main body 136 of the contact pads 128 are inserted into slots 120 respectively on the first portion 100 of the barrel attachment 94. The first ends 132 of the contact pads 128 are adjacent to the first end 96 of the barrel attachment 94, and the second ends 134 are adjacent to the second end 98 of the barrel attachment 94. The slots 120 and contact pads 128 are sized so that the main body 136 and friction surfaces 130 are capable of protruding through the slots 120 into the passage 110. When the contact pads 128 are inserted into the slots 120, the contact surfaces 130 face the passage 110. As shown in FIG. 23, the contact pads 128 are prevented from completely falling or sliding through the slot 120 into the longitudinal passage 110 by the biasing extensions 144 and 146 which rest upon the outer side 148 of the first portion 100 of the barrel attachment 94.

Figure 19:
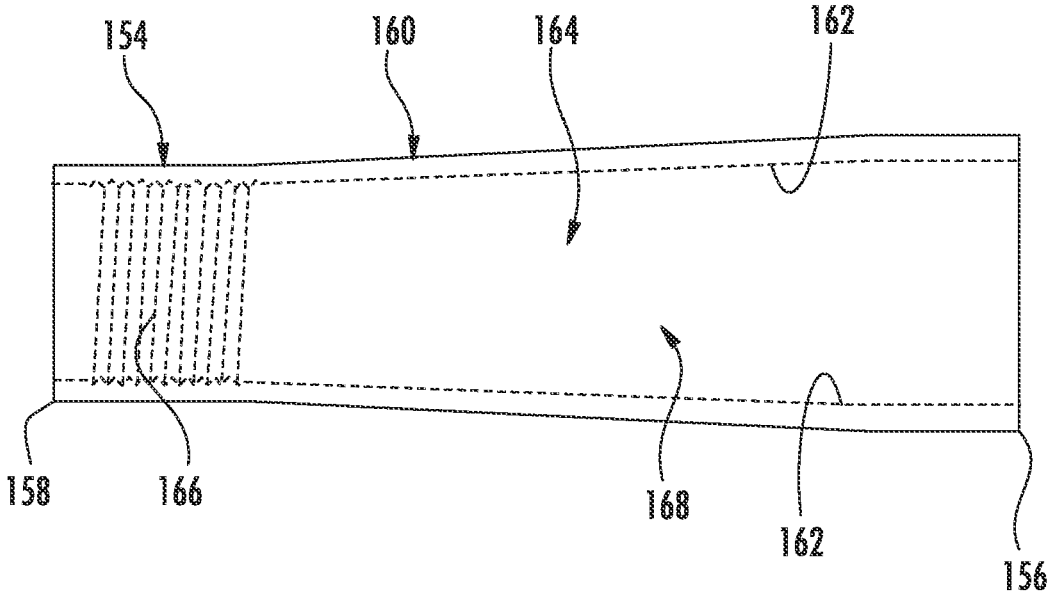
FIG. 19 is a side plan view of an adjustment sleeve with inner parts shown in phantom.
Figure 20:
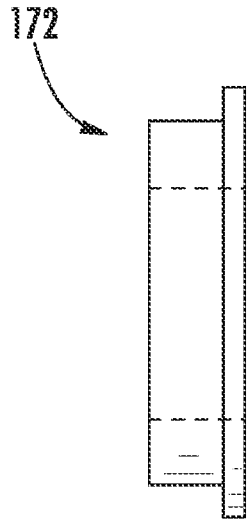
FIG. 20 is a side plan view of an end cap.
Figure 21:
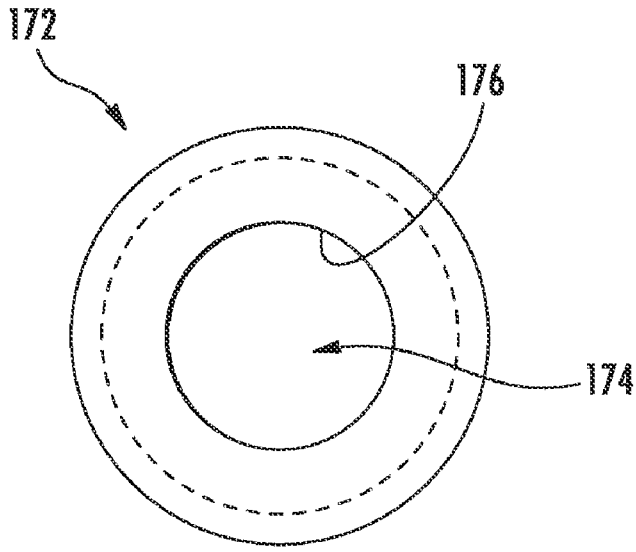
FIG. 21 is a front plan view of the end cap shown in FIG. 20.

A generally frusto-conically shaped adjustment sleeve 154 is shown in detail in FIG. 19. The adjustment sleeve 154 has an open first end 156, an open second end 158, an outer surface 160 and an inner wall 162, and a main body portion 164. The adjustment sleeve 154 has a threaded section 166 which is matingly engagable with the threads 112 on the outer surface of the sleeve 106 of the barrel attachment 94 (as shown in FIGS. 15, 17 and 23). The inner wall 162 of the adjustment sleeve 154 defines a sleeve passage 168 running therethrough. As shown in FIG. 23, the adjustment sleeve passage 168 is formed having a diameter, adjacent the second end 158 of the adjustment sleeve 154, sized to receive the sleeve 106 of the barrel attachment 94, with the diameter of the adjustment sleeve 154 increasing from the second end 158 to the first end 156. This increasing diameter creates a sloped inner wall 162, which is shown in detail in FIG. 19.

As shown in FIGS. 15-18 and 23-25, the barrel attachment 94 fits within the adjustment sleeve 154, whereby the adjustment sleeve 154 coaxially surrounds the barrel attachment 94. The adjustment sleeve 154 is preferably, coaxial with the cylindrical barrel attachment 94. As shown in detail in FIG. 23, the threads 112 of the barrel attachment 94 threadably engage the threads 166 of the adjustment sleeve 154. As shown in FIGS. 16 and 18, the contact pads 128 are positioned within the space 170 between the inner wall 162 of the adjustment sleeve 154, and the outer wall 148 of the first portion 100 of the barrel attachment 94. As shown in FIGS. 12, 15 and 17, the contact pads 128 are preferably formed so that the outer side 138 is sloped corresponding to the sloped inner wall 162 of the adjustment sleeve 154.

As shown in FIGS. 11 and 19, the first end 96 of the barrel attachment 94 and the first end 156 of the adjustment sleeve 154 are open. Thus, dirt and debris can get into the spaces 170 (shown in FIGS. 16 and 18) during use. Therefore, as shown in detail in FIGS. 20 and 21, an end cap 172 may be provided. As shown in FIGS. 23-25, the end cap 172 closes off the first end 156 of the adjustment sleeve 154. The end cap 172 may be secured to the first end 156 of the adjustment sleeve 154 and/or first portion 100 of the barrel attachment 94 by snapping engagement, threaded engagement, or frictional engagement. As shown in detail in FIG. 21, the end cap 172 has an end cap passage 174 defined by an inner wall 176. As shown in FIGS. 24-25, the diameter of the end cap passage 174 is preferably sized so that projectiles 26 passing through the passage 174 can exit without contacting the inner wall 176.

The threaded engagement 112 and 166 of the adjustment sleeve 154 and the sleeve 106, shown for example, in FIG. 23, allows a user 28 (FIGS. 6-9) to selectively adjust the amount of spin imparted upon a projectile 26 passing through the passage 110 by selectively adjusting the degree to which the contact pads 128 protrude into the passage 110. FIG. 24 shows the adjustment sleeve 154 in a first (rearward) position. In this position, the adjustment sleeve is more toward the second end 98 of the barrel attachment 94. The adjustment sleeve 154 may be rotated about the barrel attachment 94 toward a second (forward position), which is shown in FIG. 25. In this position, the adjustment sleeve 154 is more toward the first end 96 of the barrel attachment 94.

As shown in FIGS. 17, 18 and 25, due to the sloped wall 162 of the adjustment sleeve 154, and the sloped outer side 138 of the contact pads 128, moving the adjustment sleeve 154 from a first position to a second position will cause the contact surfaces 130 of the contact pads 128 to protrude into the passage 110 in varying degrees. In the first position, shown in FIGS. 15, 16 and 24, the sloped walls 162 of the adjustment sleeve 154 contact the sloped outer sides 138 of the contact pads 128 to the least degree, and the volume of the space 170 between the sloped walls 162 and the outer side 148 of the first portion 100 of the barrel attachment 94, is greatest. In the first position, as shown in FIG. 16, the contact pads 128 do not protrude through the slots 120 into the longitudinal passage 110 of the barrel attachment 94, or, they protrude only slightly depending upon the arrangement. In fact, the contact portions 130 may be flush with the inner wall 108 of the barrel attachment 94. As shown in FIG. 24, when the adjustment sleeve 154 is in this position, the contact portions 130A and 130B of the contact pads 128 will not contact the projectile 26 and therefore, no spin will be imparted upon the projectile 26. Thus, the projectile 26 will leave the longitudinal passage 110 straight; i.e., along the longitudinal axis 114, and travel with a relatively parabolic trajectory under the force of gravity.

As the adjustment sleeve 154 is turned toward the second position, as shown in FIGS. 17 and 18, the decreasing diameter of the sloped wall 162 of the adjustment sleeve 154 will move toward the first end 96 of the barrel attachment 94. Moving the adjustment sleeve 154 toward the second position effectively decreases the diameter of the adjustment sleeve passage 168 at the first end 132 of the contact pads 128. In other words, the more sloped (i.e., more rearward) portion of the adjustment sleeve 154 inner wall 162 moves closer to surrounding the first ends 132 of the contact pads 128. Thus, the sloped walls 162 of the adjustment sleeve 154 press against the sloped, outer side 138 of the contact pads 128, nearer toward the larger first end 132. As shown in FIG. 18, this causes a portion of the main body 136 of the contact pads 128 and the contact surfaces 130 to increasingly protrude into the longitudinal passage 110. As shown in FIG. 17, the biasing elements 144,146 maintain the contact pads 128 in position, prevent the contact pads 128 from falling into the longitudinal passage 110, and provide a biasing force when a projectile 26 contacts the contact surface 130.

As shown in FIGS. 18 and 25, when the contact pads 128 are pressed into the passage 110 to a greater degree, the effective diameter of the passage 110 will be decreased. Thus, rotating the adjustment sleeve 154 to the second position allows the contact pads 128 to contact projectiles 26 having a smaller diameter. It also, allows the contact pads 128 to make greater contact with a projectiles 26 passing through the passage. Greater contact creates a greater frictional force 178 at the contact point 180 (shown in FIG. 25), which imparts more spin 184 on a projectile 26. This spin alters the projectile's trajectory. Therefore, by rotating the adjustment sleeve 154 about the barrel attachment 94 between the adjustment sleeve 154 forward and backward positions, the user 28 (FIGS. 6-9) can adjust the amount of spin 184 on the projectile 26 and thus, the amount of curve in the projectile's 26 trajectory.

In addition, in the preferred embodiment, a securing element, which may be a set screw, a pin, a wing nut, a dowel, a hook, a latch and a spring loaded detent or other similar means are provided for allowing a user 28 to set the position of the adjustment sleeve 154 relative to the barrel attachment 94. The set screw preferably, protrudes from the outer housing 160 at the second end 158 of the adjustment sleeve 154 and is capable of extending through the housing into the threads 112 on the outer surface of the sleeve 106. When the set screw is extended into a groove in the threads 112, it prevents the adjustment sleeve from rotating. This allows a user 28 to set the adjustment sleeve 154 at positions in between the first and second positions, which gives the user 28 greater control over the degree of spin on the projectile 26. It also allows the user 28 to more easily rotate the spin attachment 94 relative to the first end 32 of the barrel 16 while keeping the adjustment sleeve 154 in position.

FIGS. 22-25 show the preferred configuration of the barrel attachment 94 with respect to the barrel 16. Four contact pads 154 are placed in four corresponding slots 120 as shown in FIG. 22. The contact pads 128 are located in two slots 120 in an upper portion of the annular wall 108 of the barrel attachment 94 and two slots 120 in the lower portion of the annular wall 108. Preferably, the contact pads 128 located in the slots 120 along the upper portion have a contact surface comprised of the same material—designated as 130A and the contact pads 128 in the slots 120 along the lower portion inner wall have a contact surface comprised of the same material 130B. The contact surface 130B is preferably different than that of 130A. In the preferred embodiment, the contact surface 130A has a coefficient of friction greater than that of 130B.

As shown in FIGS. 24 and 25, the first end 32 of the gun barrel 16 fits within the sleeve 106 as described in the embodiment shown in FIGS. 1-5. A projectile fired from the gas gun (not shown), moves through the inner bore 22 of the gun barrel and into the longitudinal passage 110. As shown in FIG. 24, if the adjustment sleeve is in the first position and thus, the contact pads 128 do not protrude into the longitudinal passage 110, the projectile 26 will not contact or only slightly contact the contact pad 154 contact surfaces 130A and 130B. Therefore, very little, or no spin is placed on the projectile 26. The projectile 26 will exit the end cap passage 174 relatively straight and will travel with a parabolic trajectory. But if the adjustment sleeve 154 is moved toward the second position and thus, the contact pads 128 protrude into the longitudinal passage 110, the projectile 26 will contact the contact pad 128 contact surfaces 130A and 130B. At the point of contact 180 with the contact surface 130A, the projectile 26 is decelerated more rapidly than at the point of contact 182. This induces spin 184 on the projectile 26. If the contact pads 128 with contact surface 130A are located at the top (as shown in Fig. 22) when the gun 10 is fired, the barrel attachment 94 will put "backspin" 184 on the projectile 26. This "backspin" 184 is illustrated by the arrow in FIG. 25. The backspin 184 causes the projectile 26 to leave the barrel attachment 94 and end cap passage 174 with an upward trajectory or path (relatively to the central axis 114). As previously explained, the backspin 184 rotation counteracts gravity, which gives the projectile 26 a relatively straight trajectory as compared to the trajectory of a projectile 26 fired without backspin 184 (FIG. 24). This relatively straight trajectory allows the projectile 26 to travel farther than if fired without backspin 184 and, it makes the marker more accurate because the straight trajectory allows a user to take aim directly at the target 86 and thus, the user 28 does not have to aim above the target to compensate for the parabolic trajectory, as when firing a projectile without backspin.

Similar to the embodiment shown in FIGS. 1-5, the barrel attachment 94 and adjustment sleeve 154 can be rotated about the muzzle end 32 of the gun barrel 16, which effectively changes the points of contact 180, 182 on the projectile 26 and thereby allows a user 28 to change the direction of spin. If the contact pads 128 are rotated ninety degrees to the right, the contact surface 130A contacts and decelerates the right side of the projectile 26 causing it to curve to the right, the effect of which is shown in FIG. 8. To allow a user 28 to more accurately adjust the direction of spin, the barrel attachment 94 may have an adjustment setting indicator (not shown) disposed on the outer surface 160 of the sleeve 154 or the barrel attachment 94 that indicates the position of the contact pads 128.

Figure 26:
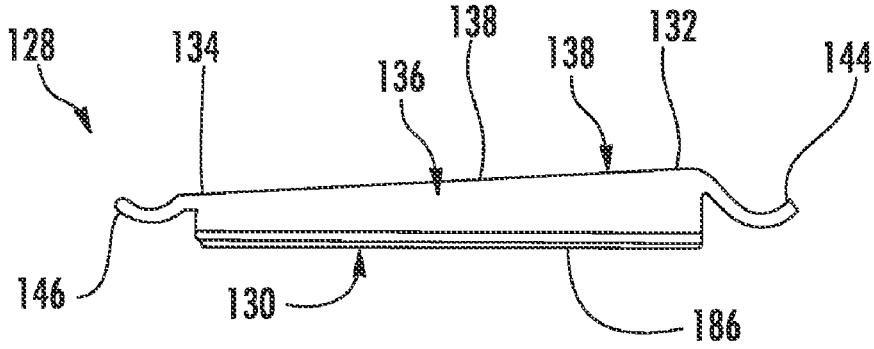
FIG. 26 is a side plan view of another embodiment of a contact pad for use in the second embodiment of the barrel attachment of the present invention.
Figure 27:
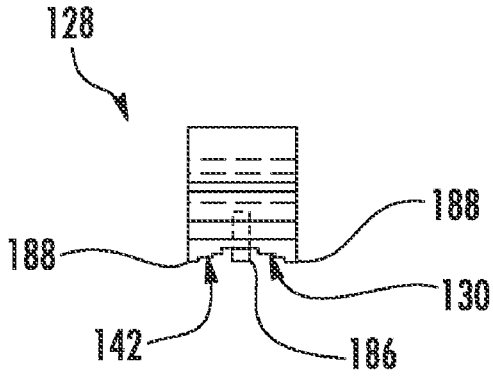
FIG. 27 is a front view of another embodiment of a contact pad for use second embodiment of the barrel attachment of the present invention.

FIGS. 26 and 27 show another embodiment of a contact pad 128 for use in the barrel attachment 94 of the present invention. In this embodiment, the contact portion 130 of the contact pad 128 contains a scoring member or sharp edge 186 in the center of the arc 142. Preferably, the sharp edge 186 is thinner than the area of the contact portion 130. But the sharp edge 186 may be of any length, thickness, shape etc. sufficient to score and impart friction upon a projectile 26. As shown in FIG. 26, this edge 186 runs along the length of the main body 136 of the contact pad 128. In this embodiment, the edges 188 of the contact surface 130 of the contact pad 128 impart friction 178 and spin 184 on the projectile 26. The sharp edge 186 scores or slightly cuts and/or imparts friction along the circumferential surface of the projectile 26. In other words, the sharp edge 186 does not puncture the projectile 26 at a point, but scores it along its outer shell. Because the projectile 26 is scored it is more likely that the projectile 26 will break apart on contact with a target 86 (FIGS. 6-9) and release the dye contained within. Even if the projectile 26 does not break apart, the scoring makes it more likely that the projectile 26 will release at least some dye on the target 86, which in most games, is enough to eliminate the opponent 86. Because in most games, the target 86 is eliminated only if the dye releases on him or her, this feature of the present invention makes it more likely that the user will eliminate an opposing player 86. If the barrel 16 (FIG. 10) scores the projectile, it is likely that the projectile will break within the bore 22 (FIGS. 24 and 25). This embodiment is advantageous because it allows the user 28 (FIGS. 6-9) to score the projectile 26 just before it leaves the spin attachment 94, which virtually eliminates the possibility that the projectile 26 will break within the passage 110 or gun barrel bore 22. In addition, this embodiment is advantageous because a lower gas pressure can be used to fire projectiles 26 because if the projectile 26 is scored it does not need to travel with a fast velocity to break.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiments are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A compressed gas gun barrel attachment comprising:

a cylindrical housing having first and second ends and a through passage therebetween, the first end fittable over a gun barrel, the housing having at least one aperture therethrough;

at least one contact pad, the at least one contact pad comprising a contact surface that is selectively extendable through the at least one aperture and at least partially into the through passage, the contact surface positionable within the through passage to contact a projectile launched from the gun barrel; and, an outer adjustment sleeve coaxial with the cylindrical housing, the adjustment sleeve moveable to adjust the amount the at least one contact pad extends into the through passage.

2. The barrel attachment of claim 1 wherein the adjustment sleeve has a frusto-conical shape and the contact pad comprises a sloped main body having first and second ends and wherein axial displacement of the adjustment sleeve, relative to the housing, biases the at least one pad toward the through passage.

3. The barrel attachment of claim 2 wherein the housing further comprises outer threads at its second end, and wherein the adjustment sleeve further comprises inner threads matingly engagable with the outer threads of the housing.

4. The barrel attachment of claim 3 wherein the adjustment sleeve further comprises a securing element to secure the outer sleeve in place.

5. The barrel attachment of claim 4 wherein the securing element is selected from the group consisting of: a set screw, a pin, a wing nut, a dowel, a hook, a latch and a spring loaded detent.

6. The barrel attachment of claim 1, wherein the at least one contact pad comprises at least one biasing element.

7. A compressed gas gun barrel attachment comprising:

a cylindrical housing having first and second ends and a through passage therebetween, the second end fittable over a gun barrel;

at least four contact pads each having a biasing element;

the housing having at least four apertures therethrough, the at least four apertures dimensioned to receive at least a portion of the at least four contact pads, each of the at least four contact pads having a contact surface extendable at least partially into the through passage, at least one of the contact surfaces having different coefficients of friction than the others; and an outer adjustment sleeve coaxial with the cylindrical housing, the adjustment sleeve moveable to adjust the amount the at least one contact pad extends into the through passage.

* * * * *